US009522411B2

(12) United States Patent
Harris et al.

(10) Patent No.: US 9,522,411 B2
(45) Date of Patent: Dec. 20, 2016

(54) HYBRID EXTRUSION AND COATING TECHNOLOGY, DEVICE, AND METHOD

(71) Applicant: Georgia Tech Research Corporation, Atlanta, GA (US)

(72) Inventors: Tequila Harris, Atlanta, GA (US); Matthew Brown, Houston, TX (US)

(73) Assignee: GEORGIA TECH RESEARCH CORPORATION, Atlanta, GA (US)

( * ) Notice: Subject to any disclaimer, the term of this patent is extended or adjusted under 35 U.S.C. 154(b) by 99 days.

(21) Appl. No.: 14/147,226

(22) Filed: Jan. 3, 2014

(65) Prior Publication Data

US 2014/0186530 A1 Jul. 3, 2014

Related U.S. Application Data

(60) Provisional application No. 61/748,534, filed on Jan. 3, 2013.

(51) Int. Cl.

| | |
|---|---|
| ***B05C 5/02*** | (2006.01) |
| *B05D 5/06* | (2006.01) |
| *B05D 1/26* | (2006.01) |

(52) U.S. Cl.
CPC ..... *B05C 5/0225* (2013.01); *B05C 5/0258* (2013.01); *B05C 5/025* (2013.01); *B05D 1/265* (2013.01); *B05D 5/06* (2013.01)

(58) Field of Classification Search
CPC ..... B05C 5/0258; B05C 5/0225; B05D 1/265
See application file for complete search history.

(56) References Cited

U.S. PATENT DOCUMENTS

| | | | | |
|---|---|---|---|---|
| 5,161,449 | A * | 11/1992 | Everett, Jr. | F15B 11/0725 60/562 |
| 6,953,079 | B2 * | 10/2005 | Suzuki | B22D 17/2236 164/256 |
| 2009/0301231 | A1 * | 12/2009 | Wang | B01L 3/0265 73/864.11 |

* cited by examiner

*Primary Examiner* — Xiao Zhao
(74) *Attorney, Agent, or Firm* — Troutman Sanders LLP; Ryan A. Schneider; Troy S. Kleckley

(57) ABSTRACT

A hybrid patterning apparatus and system for producing thin films on demand from customized patterns is disclosed. The apparatus includes a slot die body integrated with inkjet actuators. The hybrid patterning apparatus may be used in a method of preparing patterned thin film materials.

16 Claims, 20 Drawing Sheets

106

| Inputs | | | | Output |
|---|---|---|---|---|
| 1 | 2 | 3 | 4 | Pin |
| 0 | 0 | 0 | 0 | 126a |
| 1 | 0 | 0 | 0 | 126b |
| 0 | 1 | 0 | 0 | 126c |
| 1 | 1 | 0 | 0 | 126d |
| 0 | 0 | 1 | 0 | 126e |
| 1 | 0 | 1 | 0 | 126f |
| 0 | 1 | 1 | 0 | 126g |
| 1 | 1 | 1 | 0 | 126h |
| 0 | 0 | 0 | 1 | 126i |
| 1 | 0 | 0 | 1 | 126j |
| 0 | 1 | 0 | 1 | 126k |
| 1 | 1 | 0 | 1 | 126l |
| 0 | 0 | 1 | 1 | 126m |
| 1 | 0 | 1 | 0 | 126n |
| 0 | 1 | 1 | 1 | 126o |
| 1 | 1 | 1 | 1 | 126p |

HYBRID EXTRUSION AND COATING TECHNOLOGY, DEVICE, AND METHOD

CROSS-REFERENCE TO RELATED APPLICATIONS

This application priority under 35 U.S.C. §119(e) to U.S. Provisional Patent Application Ser. No. 61/748,531, filed 3 Jan. 2013, which is hereby incorporated in its entirety as if fully set forth herein.

TECHNICAL FIELD

The various embodiments of this disclosure relate generally to coating thin films and, more particularly, to an apparatus and method for producing patterned thin films.

BACKGROUND

There are many processes for creating thin films, and these methods were developed to meet the manufacturing needs of specific technologies. For example, existing solution coating technologies such as slot die, curtain, and knife coating are able to manufacture thin films with high throughput. These techniques were designed for creating high quality films in continuous single sheets. These techniques, however, have a limited ability to create patterns.

Slot die coating is a method of creating thin films on a substrate from liquid materials. The essence of the process is a die consisting of two halves separated by a shim, with a pressurized reservoir, or chamber, machined into one of the halves containing fluid. The purpose of the shim is to create a gap between the two halves through which the fluid may flow. The purpose of the chamber is to uniformly distribute the fluid therein along the width of the gap. As a result, slot die designs are generally limited to lines or stripes that are the opening of the shim, thereby limiting the ability of the slot die to create other desired patterns.

Unlike solution coating, which is a continuous process, printing technology is designed to deposit material when and where it is needed. The principle of an inkjet process is that, based on an input pattern such as a body of text or an electronic circuit, a nozzle moves to a predetermined location and deposits solution. Deposition is obtained via digital command and resulting actuation of a jet dispensing mechanism. Inkjet printing is a process in which the product (line, film, etc.) consists of a buildup of individual ink droplets. Because deposition of the fluid can be precisely controlled, ink jet printing is capable of and excels at making films with sophisticated patterns. The buildup nature, however, does not produce as continuous or high quality a film as an extrusion process does. Moreover, ink jet printing suffers from low throughput capacity.

Another thin film production technique with high throughput is gravure printing. The basic operation for this process is a drum with a pattern of voids etched into it. Ink is fed into the voids and deposited on a substrate via pressure between the drum and the substrate. Like slot die coating, however, this process provides no customization of extruded patterns.

Today, there are emergent technologies such as organic electronics, battery electrodes, and radio frequency identification tags that would benefit from thin film manufacturing. While such emergent technologies use materials that are compatible with the aforementioned high throughput coating methods, they require patterning of films. These technologies, therefore, are largely restricted to ink jet printing and vapor deposition methods. This is partially because the required patterns are too sophisticated for processes such as gravure printing and slot die, knife and spray coating without the inclusion of multiple secondary operations that are detrimental to throughput.

A key enabling development for the emergent technologies would be suitable manufacturing processes that provide high production capacity and coating of thin films in continuous discrete and non-discrete patterns. Modified slot die coating has been shown to be an ideal technology to coat printed lines; however, a major limitation of the modified slot die coating process is the lack of a dynamic, direct patterning. More specifically, it is a static process that does not allow for programmed input of coating patterns. Other high throughput methods used to coat patterns also suffer from being static systems or requiring intricate material removal steps and are often expensive.

Patterned thin films that can be produced rapidly with good uniformity are useful in emerging technologies. A need exists for a dynamic, customizable patterning process for thin film production having high throughput and optimization of patterns without increasing manufacturing costs.

SUMMARY

Some embodiments of this disclosure provide an apparatus and a system for patterning thin film materials. Other embodiments provide methods of producing patterned thin film materials.

To realize a system capable of producing on-demand, patterned films of high uniformity, there is provided a hybrid patterning die system. This system allows for the computer-controlled benefits of inkjet printing to be combined with the coating capabilities of slot die extrusion. With such a system, desired film patterns can be created in a digital file, and the digital file used to control operation of the coating process. This provides improved patterned thin film processing for technologies that require high-quality and customizable films.

According to some embodiments of this disclosure, an apparatus for patterning thin films includes a slot die having a body comprising first and second plates. Each of the first and second plates has a top end and a bottom end. Located at the top end of the slot die body is an inlet. A cavity is positioned between the first and second plates of the slot die. Leading from the cavity to an opening at the bottom end of the slot die is a slot gap. The hybrid patterning apparatus also includes at least one moveable pin. The internal end of the pin is located inside the slot die body and fills at least a portion of the slot gap, while the external end of the pin extends beyond the exterior of the slot die body. The hybrid patterning apparatus may further comprise at least one actuator connected to the external end of the at least one pin. The at least one actuator may also be connected to the exterior of the slot die body.

According to other embodiments of this disclosure is a hybrid system for patterning thin film materials. The hybrid patterning system includes a hybrid patterning apparatus, a power source, and an actuator control system. The hybrid patterning apparatus includes a slot die having a body comprising first and second plates. Each of the first and second plates has a top end and a bottom end. A cavity is positioned between the first and second plates of the slot die. Leading from the cavity to an opening at the bottom end of the slot die is a slot gap. The hybrid patterning apparatus also includes at least one moveable pin. The internal end of the pin is located inside the slot die body and fills at least a portion of the slot gap, while the external end of the pin extends beyond the exterior of the slot die body. The hybrid patterning apparatus may further comprise at least one actuator connected to the external end of the at least one pin. The at least one actuator may also be connected to the exterior of the slot die body.

According to other embodiments of this disclosure is a method of making patterned thin film materials. The method can include designing a surface pattern, inputting parameters of the designed surface pattern into a computer, passing a substrate having a substrate surface under a hybrid patterning apparatus, and patterning the designed surface pattern onto the passing substrate surface using the hybrid patterning apparatus.

Other aspects and features of embodiments of this disclosure will become apparent to those of ordinary skill in the art, upon reviewing the following description of specific, exemplary embodiments of this disclosure in concert with the various figures. While features of this disclosure may be discussed relative to certain embodiments and figures, all embodiments of this disclosure can include one or more of the features discussed in this application. While one or more embodiments may be discussed as having certain advantageous features, one or more of such features may also be used with the other various embodiments discussed in this application. In similar fashion, while exemplary embodiments may be discussed below as system or method embodiments, it is to be understood that such exemplary embodiments can be implemented in various devices, systems, and methods. As such, discussion of one feature with one embodiment does not limit other embodiments from possessing and including that same feature.

BRIEF DESCRIPTION OF THE DRAWINGS

FIGS. 8*a-d* illustrates coupling a DC power source to a series of actuators in accordance with an exemplary embodiment of the disclosure.

FIGS. 11*a-d* illustrates actuator modes of operation in accordance with an exemplary embodiment of the disclosure.

DETAILED DESCRIPTION

Figure 1:
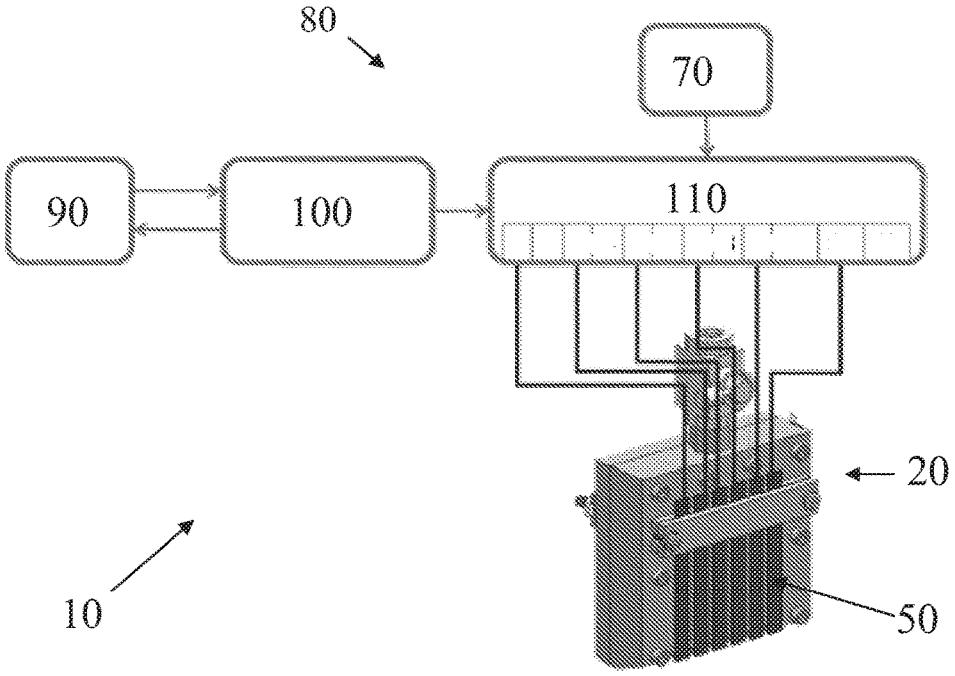
FIG. 1 illustrates a hybrid patterning apparatus in accordance with an exemplary embodiment of the disclosure.

Referring now to the figures, wherein like reference numerals represent like parts throughout the several views, exemplary embodiments of this disclosure will be described in detail. Throughout this description, various components may be identified having specific values or parameters; however, these items are provided as exemplary embodiments. Indeed, the exemplary embodiments do not limit the various aspects and concepts of this disclosure as many comparable parameters, sizes, ranges, and/or values may be implemented.

The various embodiments of this disclosure relate to a system and apparatus for the patterning of thin films. The methods of manufacturing patterned thin films using the hybrid system are also described herein.

Referring now to FIG. 1, there is shown a hybrid patterning system 10 in accordance with an exemplary embodiment of this disclosure. System 10 includes hybrid patterning apparatus 20, which is an apparatus for patterning thin films that includes a slot die.

Figure 2:
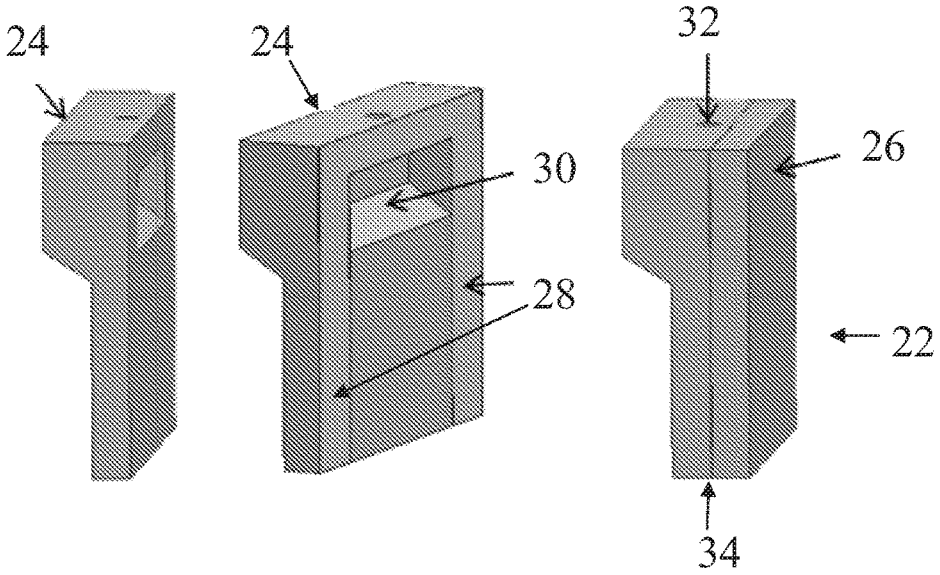
FIG. 2 illustrates components of a typical slot die.

FIG. 2 shows typical slot die components. As shown in FIG. 2, the essence of the slot die coating process is a slot die that includes a body 22 having two halves, or first and second plates, 24, 26, separated by a shim 28, and a pressurized reservoir, or cavity, 30 positioned between first and second plates 24, 26 for containing fluid to be deposited. Slot die body 22 also includes fluid inlet 32 positioned at the top. The purpose of shim 28 is to create a slot gap 34 between first and second plates 24, 26 through which the fluid may flow. Slot gap 34 leads from cavity 30 to an opening at the bottom of slot die body 22. Cavity 30 is machined into one of first and second plates 24, 26 for the purpose of uniformly distributing fluid therefrom along the width of slot gap 34.

Figure 3:
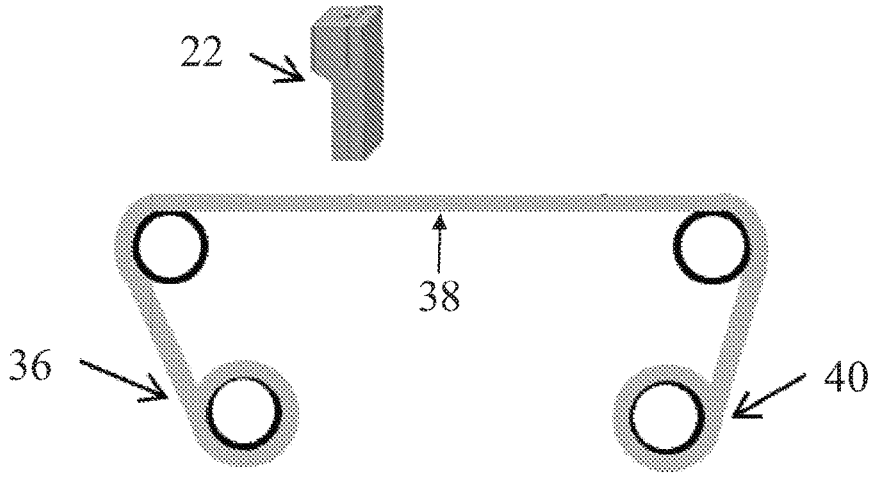
FIG. 3 illustrates a basic slot die process in accordance with an exemplary embodiment of the disclosure.

FIG. 3 shows a basic slot die coating process setup. Substrate feed 36 feeds substrate 38 past slot die body 22. As substrate 38 passes slot die body 22, fluid exits via slot gap 34 and is deposited on substrate 38. Substrate 38 continues to move along to substrate roll up 40.

Figure 4:
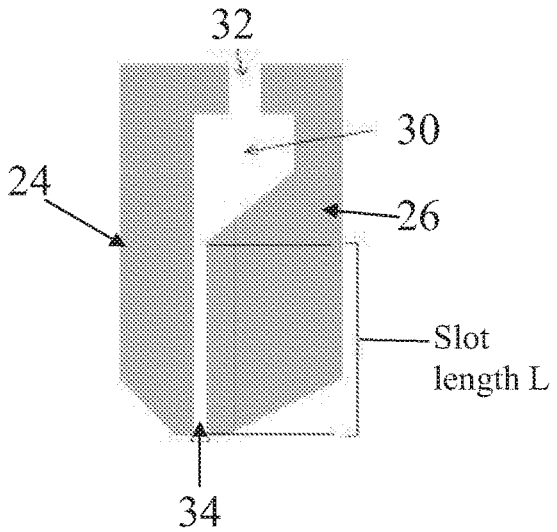
FIG. 4 illustrates a cross section view of a slot die having the T-cavity geometry in accordance with an exemplary embodiment of the disclosure.

The design of a slot die can be intended to produce a continuous, uniform flow of fluid. To obtain uniform flow, fluid and pressure should be distributed evenly across the width of the die cavity. This can be controlled by the cavity geometry. There can be two primary cavity designs, T-cavity and coat-hanger. In a preferred embodiment, the T-cavity geometry is shown in FIG. 3. FIG. 4 is a cross section view of slot die body 22 in which cavity 30 is of T-cavity geometry.

As also shown in FIG. 4, slot die body 22 has a slot length L. A primary function of slot length L can be to control the speed of the fluid based on the inlet pressure. Flow along slot length L may be characterized by the pressure gradient between first and second plates 24, 26. Greater values of slot length L will give slower outlet speeds for a given inlet pressure. Another consideration in relation to slot length L can be the integration of actuators, which will be addressed in more detail later. Mainly, slot length L and the overall size of slot die body 22 should be such that it can accommodate the integration of actuators.

Slot die body 22 may be made of any machineable material typically used in making slot die. These include but are not limited to stainless steel, aluminum, titanium, nylon, polycarbonate and combinations thereof. The material used to make slot die body 22 generally is a function of the fluid that will be deposited. There should be compatibility between the slot die and the fluid with respect to chemical, electrical, mechanical, and physical properties.

Hybrid patterning apparatus 20 includes the use of at least one actuator 50. While the embodiments in this disclosure will be described using piezoelectric actuators, other actuators useful herein include pneumatic, electrostatic, and electromagnetic actuation technology. Suitable piezoelectric actuators are available from American Piezo Company and Piezo Systems, Inc., particularly commercial actuators T-220-A4-103× from Piezo Systems Inc. Servo motors may also be used.

Figures 5A, 5B:
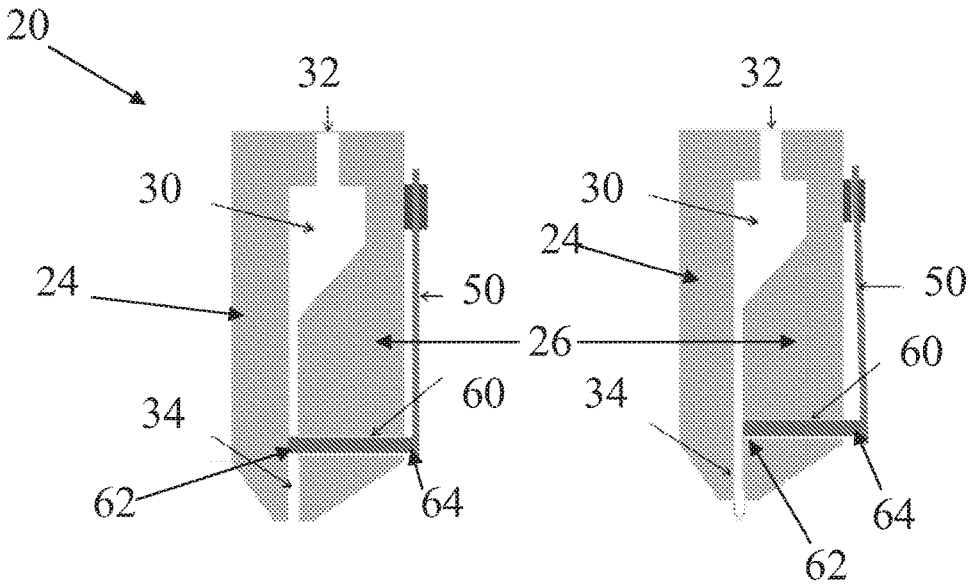
FIGS. 5*a* and 5*b* illustrate pin operation controlling the fluid exiting the hybrid patterning apparatus in accordance with an exemplary embodiment of the disclosure.
Figure 6:
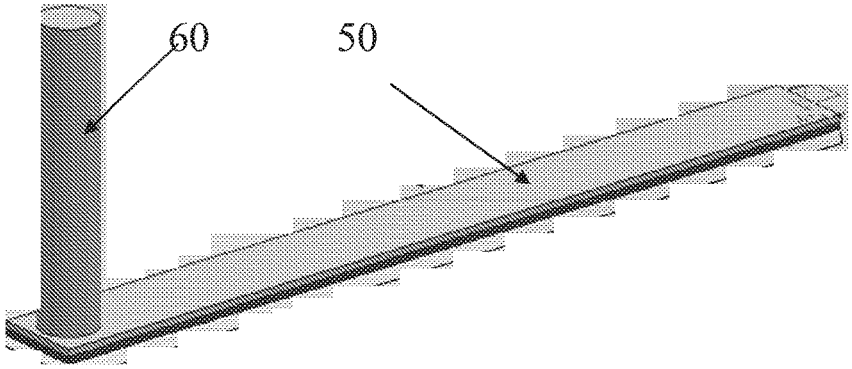
FIG. 6 illustrates a single actuator with a single pin attached thereto in accordance with an exemplary embodiment of the disclosure.

As can be seen in FIGS. 5*a* and 5*b*, hybrid patterning apparatus 20 also includes at least one moveable pin 60. At least one pin 60 includes an internal end 62 and an external end 64. Internal end 62 fills at least a portion of slot gap 34. In an alternative embodiment, slop gap 34 may further be filled with a non-pin structure. External end 64 of at least one pin 60 extends beyond the exterior of slot die body 22 and connects to at least one actuator 50. FIG. 6 shows a single actuator 50 with a single pin 60 attached thereto.

Referring back to FIGS. 5*a* and 5*b*, at least one actuator 50 functions to move at least one pin 60 appropriately to allow fluid to exit slot die body 22 via slot gap 34 (FIG. 5*a*) or to prevent fluid from exiting slot die body 22 via slot gap 34 (FIG. 5*b*). At least one moveable pin 60, therefore, functions to open and close slot gap 34 on demand, which allows for the deposition of different patterns on moving substrate 38. As can be seen in FIG. 5*b*, internal end 62 of at least one pin 60 contacts slot die body 22 at one of plates 24, 26 to close slot gap 34. It is important, therefore, that each actuator 50 can move associated pin 60 at least the distance of slot gap 34. The pins contribute to the resolution of patterns that can be coated, and the pins can be changed to change the pattern on demand. Hybrid patterning apparatus 20, therefore, may be thought of as a slot die with inkjet pin actuation.

Hybrid patterning apparatus 20 may comprise a plurality of pins and actuators. The number of pins 60 (thus, the number of actuators 50) used to close slot gap 34 is dependent upon slot width 2W of slot gap 34. It should be noted that slot gap 34 also has a slot gap thickness, which is the distance between first and second plates 24, 26. For a given pin diameter $d_p$, the number of pins 60 required is determined by using Equation 1.

$$\frac{2W}{d_p} \qquad \text{Equation 1}$$

Figure 7A:
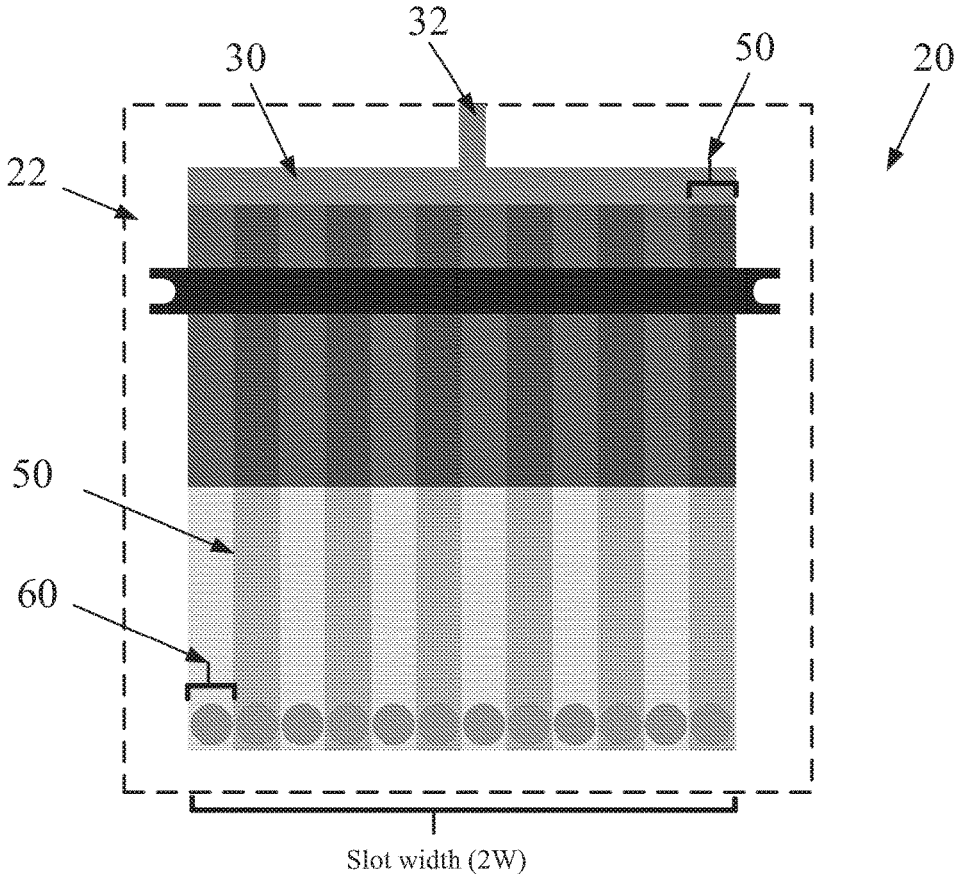
FIG. 7*a* illustrates the possible spacing of actuators in a hybrid patterning apparatus in accordance with an exemplary embodiment of the disclosure.
Figure 7B:
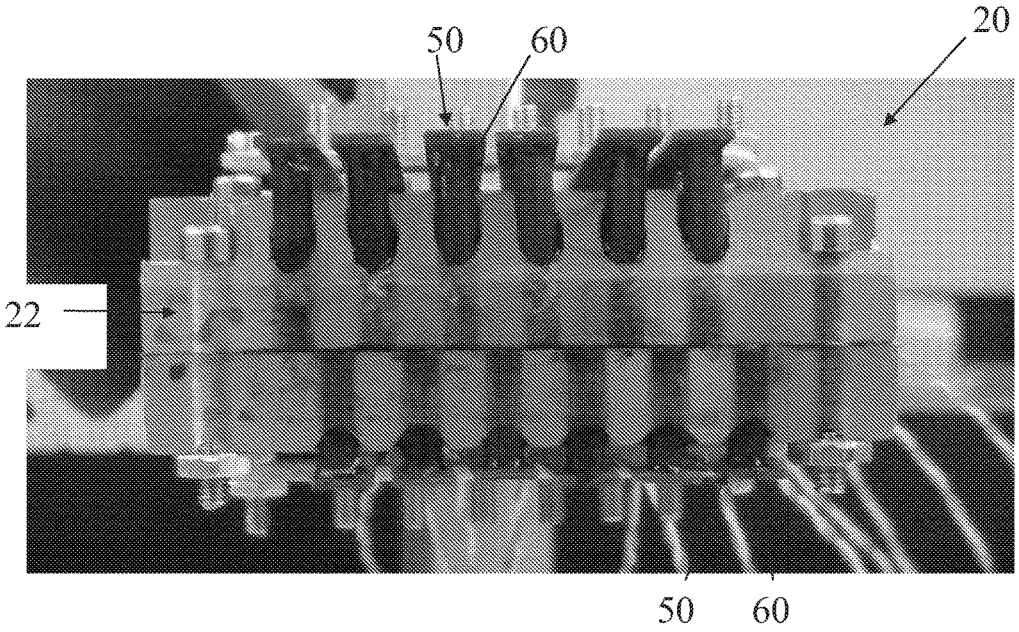
FIG. 7*b* illustrates an exemplary the hybrid patterning apparatus, viewed from the bottom, in accordance with an exemplary embodiment of the disclosure.

Because slot die body 22 comprises two plates 24, 26, the number of pins 60 (and, therefore, actuators 50) can be divided between each first and second plates 24, 26, thereby reducing spacing constraints. FIG. 7*a* shows the spacing of a plurality of pins 60 and actuators 50 for one plate of slot die apparatus 20. Preferably, a plurality of pins and actuators is evenly distributed along both plates 24, 26 of slot die body 22. In this configuration, the first pin (and actuator) would be housed in one of first or second plates 24, 26, and the second pin (and actuator) would be housed in the plate opposite of where the first pin (and actuator) is housed offset by the diameter of the pin. This alternating pattern of pins (and actuators) on opposite plates can be repeated as more pins are added. FIG. 7*b* shows a hybrid patterning apparatus 20 having a plurality of pins and actuators alternating between first and second plates 24, 26. In an alternative embodiment (not shown), a plurality of pins and actuators may only be on one of plates 24, 26. In yet another embodiment, pins and actuators extending from one side to the other can be in any order useful for laying down a pattern on the substrate 38.

To operate actuators 50, they should be connected to a power source 70, which can be seen in FIG. 1. Any power source may be used in the embodiments of this disclosure. According to an exemplary embodiment of this disclosure, power source 70 is a DC power source.

The number of actuators 50 determines the power source demand. More actuators require more power; less actuators require less power. In one embodiment, a resource-sharing method known as multiplexing can be used with the hybrid patterning system. Multiplexing reduces the demands placed on a power source. The basic concept of multiplexing for a power source can described using three groups of objects: Group 1 is a group of objects currently receiving power, i.e., being turned on; Group 2 is a group of objects that has been turned on in a previous time step and are meant to remain on but are not currently attached to the power source; and Group 3 is a group of objects that has not received power, i.e., has been turned off. Programming a multiplexing routine makes use of loops, such that there are multiple iterations, each consisting of a time period broken into time steps. During each time step, only one group may be updated (i.e., turned on or off) and, over the course of an entire iteration, all groups will be updated. For example, in iteration 1 at the first time step, Group 1 receives power while Group 2 and Group 3 remain off (they do not receive updates during this time step). At time 2 of iteration 1, Group 2 is turned on, Group 1 is not connected to the power source but remains on, and Group 3 remains off. Finally, at time 3 of iteration 1, Group 3 receives power, while Groups 1 and 2 remain on but are not updated or connected to the power supply. In iteration 2, time restarts and the same process as iteration 1 occurs. This time, because iteration 1 has been run, all the groups are technically on. In time 1 of iteration 3, Group 1 is turned off, Groups 2 and 3 remain on because they receive updates in the subsequent time steps, and so on.

Figure 8A:
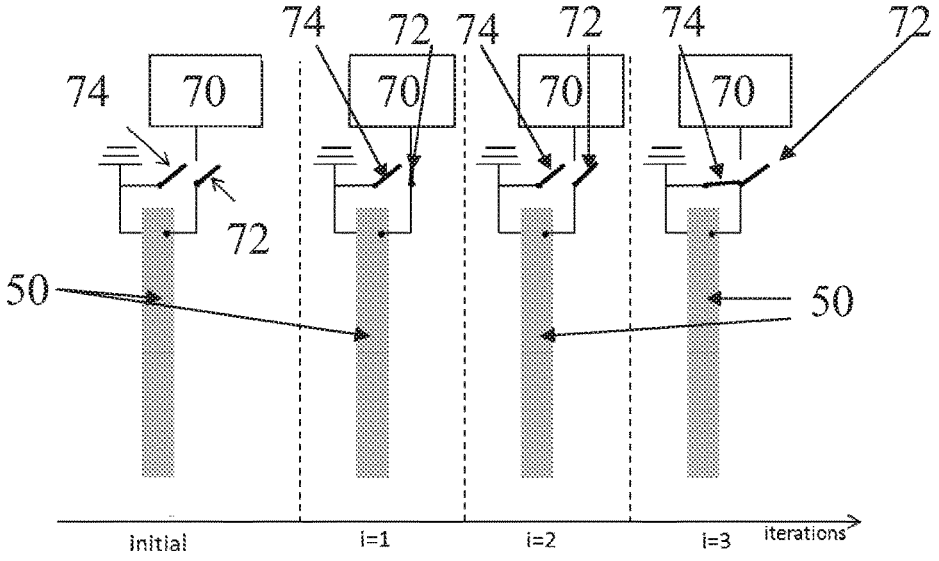

In one embodiment, a DC power source may be used in conjunction with multiplexing. As a result, bidirectional actuation may not be realizable through switching voltage polarity. Rather, it can be achieved by decoupling "on" and "off" commands in such a way that an applied voltage produces displacement, while connecting to ground returns the actuator to its original state. Controlling each actuator in this way requires two switches, or inputs, per actuator. In FIGS. 8*a-d* is a representation of this method based on an example actuator operation of being charged (turned on) and then the charge being drained (turned off). Initially, as seen in FIG. 8*a*, actuator 50 has no charge and is not connected to power source 70. In the first iteration (FIG. 8*b*), actuator 50 is connected to power source 70 by switch 72, thereby charging the piezo of actuator 50. In the subsequent iteration (FIG. 8*c*), actuator 50 is no longer connected to power source 70, but the piezo remains charged such that actuator 50 is still technically "on." For the final iteration (FIG. 8*d*), actuator 50 is turned off by closing switch 74, so that the charge is drained to ground. In practice, the switches and iterations are controlled through programming on a microcontroller, which will be discussed subsequently.

It has been discussed that multiplexing means only a single entity will receive power at a given time. As a result, iterations need to consume a minimum amount of time to maintain charge on each actuator. This translates into each time step being some minimum value. Taking this into account, a code may be implemented such that the duration of the time steps can be altered. This can be done by defining Equation 2 and Equation 3, in which f is frequency, T is time step, A is the number of actuators, C is time per command (also referred to as "execution time"), and N is the updates per command.

$$f = \frac{1}{(T \times A)} \quad \text{Equation 2}$$

$$N = C(f \times A) = \frac{C}{T} \quad \text{Equation 3}$$

Control of actuators 50 may be accomplished using an actuator control system 80. As shown in FIG. 1, actuator control system 80 consists of at least three components: main computer 90, microcontroller 100 connected to computer 90, and circuit 110 connected to microcontroller 100. Actuators 50 and power source 70 connect to circuit 110 to complete apparatus 10, as also shown in FIG. 1.

Figure 9:
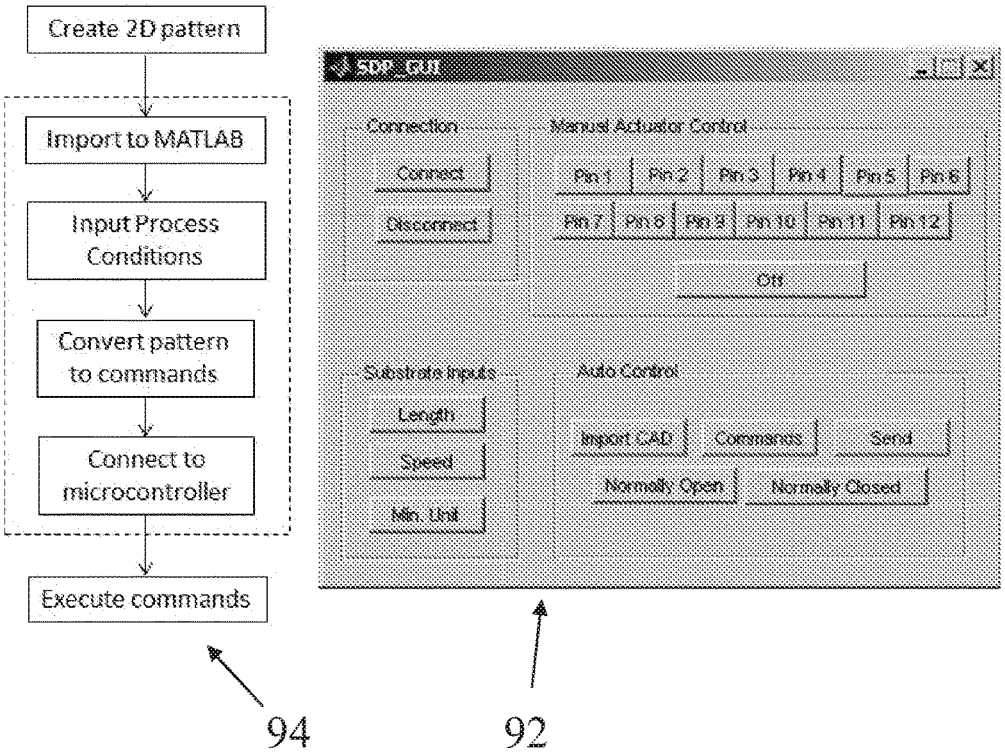
FIG. 9 illustrates the graphical user interface and task flow for operating the system in accordance with an exemplary embodiment of the disclosure.

Computer 90 can be any system capable of running a computer program for operating actuators 50. The computer program for controlling actuators receives pattern inputs and converts them to operational commands for specific actuators. The actuator control program may consist of several scripts, all of which can be linked to the graphical user interface (GUI) 92. FIG. 9 illustrates GUI 92 and task flow 94 for operation of actuators 50. Items inside the dash-lined box shown therein are functions that can be operated from GUI 92. The primary functions are to import a pattern, turn the pattern into so called actuator commands ("commands" for short), and send those commands to microcontroller 100.

A preferred actuator control program is MATLAB, such as MATLAB 2012b. In practice, a CAD pattern typically only contains the dimensions of a pattern, with no information about the processing conditions. The actuator control program can be used to produce these dimensions as a film on a substrate.

Preferably, a substrate speed as a preset value may be input at the beginning of the program execution. Using the substrate speed data and Equation 4 below, the program can calculate how long solution should be fed onto the substrate to produce a feature of a certain length. In Equation 4, Lf is the feature length, R is the substrate speed, and dt is the time.

$$L_f = R \times dt \quad \text{Equation 4}$$

Figure 10:
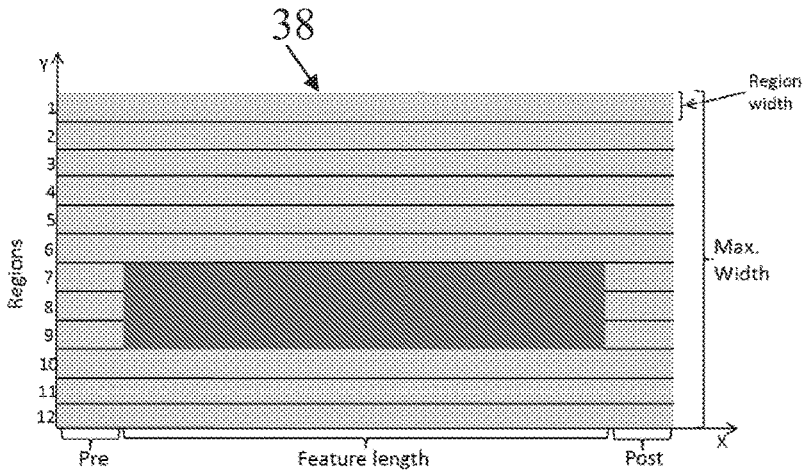
FIG. 10 illustrates a pattern feature as contained by multiple regions in accordance with an exemplary embodiment of the disclosure.

For example, to produce a line 5 cm long given a substrate speed of 1 cm/second, solution is allowed by the actuators to flow onto the substrate for 5 seconds. This can be calculated by the program based on an input pattern (a line 5 cm in length) and substrate speed. This method only accounts for the length of a feature, which is the length corresponding to the direction in which the substrate is travelling. To produce the width of a feature, which is perpendicular to the direction of substrate travel, the program breaks the drawing into regions. The number of regions is equal to the number of actuators, and the number of actuators is a coded value that can be changed for system expansion. Based on this approach, the entirety of a pattern may be contained within the regions as shown in FIG. 10. The width of each region can be determined by the diameter of the pins being used, and the maximum width of each region is controlled by the number of pins. So, for example, in a system where the pins are 2 mm and there are 12 pins, the total width is 24 mm. Any length in the X direction is possible and is only limited by substrate material, while dimensions in the Y direction are limited by the maximum width. This constraint must be kept in mind when preparing CAD drawings for input patterns.

Referring again to FIG. 10, another important detail to be considered in CAD drawings are the "pre" and "post" areas as shown therein. These represent areas where no film is to be deposited, and flow can be restricted from exiting the die in all regions. The length of substrate 38 then is the value of "pre", "feature" and "post" added together.

Using dimensions in the Y direction (contained by input CAD file), the program determines from which regions solution should exit the slot die. For example, to create the pattern shown in FIG. 10 with a given substrate speed of 1 cm/second, solution would need to exit the die in regions 7, 8, and 9 simultaneously for 5 seconds.

An important factor in producing a pattern is the resolution of features. An example of this in the X direction would be to consider 5 cm, 5.25 cm, or 5.5 cm lines. The 5.25 cm line would require the most so called resolution. As discussed previously, resolution width wise in the Y direction is controlled by the actuators. To handle length resolution, an initial user input to the GUI is "minimum unit" which, using the 5.25 cm example, would be 0.25 (units are whatever primary units are being used). This is used by the program to divide the length of the pattern into segments of 0.25. The number of segments determines the number of commands required to be sent to the microcontroller, and the execution time of each command. Considering a pattern such as the one in FIG. 10 with a 5.25 cm line, 0.5 cm pre and post, and a substrate speed of 1 cm/s, the result would be a minimum unit of 0.25, which gives 25 segments each with an execution time (for each segments) of 0.25 seconds. To realize this pattern, 25 commands will be sent to the microcontroller and each command will be executed by the microcontroller for 0.25 seconds.

Actuator commands may be formulated so as to convey information that can be used to operate actuators 50. A command is needed to communicate both the execution time and an instruction (or update) for each actuator. Each command preferably consists of three cues for microcontroller 100, a value for execution time, and instructions for each actuator 50. A general command format for use in accordance with this disclosure is Command format: $<t_c, dt, m, N, a_c, a_1, \ldots, a_n>$ where $t_c$ is the first microcontroller cue, which tells microcontroller 100 that the next information sent will be a value for execution time (dt). The second microcontroller cue is m, which tells microcontroller 100 that the next information will be N, the total number of actuator instructions. The final cue, $a_c$, tells microcontroller 100 that the information that follows will be actuator instructions. The number of actuator instructions $a_n$ corresponds to the number of actuators n.

A means of communication can be established between computer 90 and microcontroller 100 by which commands are sent. The means of communication may be wired or wireless. A wired connection may be established in several ways. According to one embodiment, the wired connection may be such that a serial connection can be obtained using a USB port on computer 90. A suitable adaptor for use in the hybrid patterning system is a Pololu USB-to-Serial adapter. In the alternative, the communication means may be any wireless setup, preferably one running serial protocol such as, for example, Bluetooth serial hardware.

Because actuator commands can be sent at a much faster rate than they can be executed, it is important that computer 90 does not overflow microcontroller 100 with actuator commands. To ensure that commands will have enough time to be executed, a simple protocol may be implemented. For example, microcontroller 100 may send a cue to computer 90 indicating it is done with the current command. Meanwhile, computer 90 will wait until it receives this cue before sending the next command.

The second component of actuator system is microcontroller 100, which includes at least one digital input/output ("I/O") ports. As previously noted, microcontroller 100 can be connected to computer 90 for communication purposes. Microcontroller 100 receives commands from computer 90 and in turn uses these commands to update actuators 50 accordingly. This may be done by connecting digital I/O ports of microcontroller 100 to circuit 110, which will subsequently be discussed in more detail. Digital I/O ports are capable of two states, high or low, which can also be called "on" or "off" and correspond to 5V and OV, respectively. The state of the ports may be determined by commands being processed by microcontroller 100. Any microcontroller having an adequate number of I/O ports can be used in the actuator control system. One example of a suitable microcontroller is a Pololu Orangutan SVP with a 20 MHz oscillator.

Figure 11A:
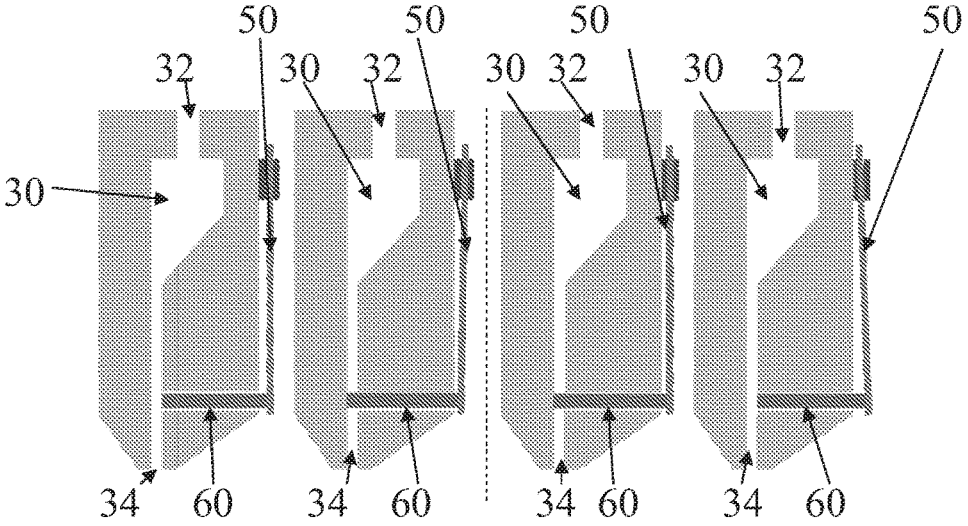

Actuators have two modes of operation, the first is typically called "normally open" and the second "normally closed." FIGS. 11*a-d* illustrate these modes of actuator operation. In the normally open mode, the normal, no electric charge state (off) of at least one actuator 50 is such that slot gap 34 of slot die body 22 is open, i.e., solution can flow through freely, as seen in FIG. 11*a*. By contrast, the normally closed mode is such that in the normal, no electric charge state (off), at least one actuator 50 closes slot gap 34, i.e., no solution should exit slot gap 34, as seen in FIG. 11*c*. The importance of these two states can be related to the action the actuator achieves when charged or turned on. In normally open, when at least one actuator 50 is turned on, it moves at least one pin 60 to close slot gap 34 and prevent solution from exiting slot gap 34 (FIG. 11*b*). The benefit of this mode of operation is that the force generated by the charged actuator can be being used to prevent flow. In normally closed mode, when at least one actuator 50 is turned on or charged (FIG. 11*d*), it moves at least one pin 60 to open slot gap 34 and permit flow to exit slot gap 34 of slot die body 22. The benefit of this mode is that there may be more control over the startup of fluid flow. The downside to this method is that no force may be being exerted to cut off flow through the slot gap.

The actuator modes of operation can be selected from GUI 92 on computer 90. By selecting the mode of operation on GUI 92, the actuator commands can be generated according to that mode of operation. These commands can then be communicated to microcontroller 100, and the commands control the state (high or low) of specific digital I/O ports. The commands contain information about the state actuators 50 should be in for certain duration to realize an input pattern. Microcontroller 100 processes these commands as in integration of multiplexing and decoupling of "on" and "off" actuator updates, as will be described herein in more detail.

Multiplexing is handled in the microcontroller program in several steps. The main idea behind multiplexing is that a resource is being shared, which in this disclosure is power source 70. Sharing is accomplished by dividing the entities requiring use of the resource, i.e., actuators 50, into groups. The groups can be as small as a single actuator or as large as all the actuators. The size of the groups depends on the scale of the system, the circuit design, and the demands placed on the power source.

The microcontroller program updates the state of each actuator individually. Microcontroller 100 receives a command from computer 90 with instructions for each actuator 50, in addition to execution time. The execution time is how long microcontroller 100 must run the current command. If each actuator were only updated once per command, multiplexing would not work efficiently because the charge on the actuators would drop significantly. Each actuator must be updated many times per command. This may be done through an iterative loop. In the first iteration of the loop, a first actuator instruction is processed. In the second iteration, a second actuator instruction is processed and so on until every actuator instruction has been processed. Then a counter within the loop resets and runs through each instruction again. The number of times an actuator instruction may be processed is controlled by the frequency f of processed actuator instructions and the total number of actuator updates per command N. Using again Equations 2 and 3, from frequency f, the period T, which is the duration of each actuator instruction for a given frequency, can be calculated. Dividing execution time C by the period T gives N. Microcontroller 100 iterates through the multiplexing loop N times, delaying each iteration by T to process each actuator instruction.

$$f = \frac{1}{(T \times A)} \qquad \text{Equation 2}$$

-continued $$N = C(f \times A) = \frac{C}{T} \quad \text{Equation 3}$$

A sufficient minimum frequency is required for operation of actuators 50. For example, in a model system, 10 Hz can be a sufficient minimum frequency to operate the actuators. The frequency needed can change depending upon the size of the hybrid patterning apparatus and the electrical components used therewith.

Operation of actuators 50 also requires a certain minimum operating voltage. For example, in a model system, the actuators can achieve, at a minimum, 63% of the operating voltage (100V in this case). The reason for 63% is based on the operation of an RC circuit. The actuators behave as capacitors, so the time constant is determined by the capacitance C of an actuator and the number of ohms R of the resistor. For example, if a 41 kΩ resistor is used, based on Equation 5, the time constant τ would be 16 ms.

$$\tau = RC \quad \text{Equation 5}$$

This is the amount of time in which the capacitor (actuator) can be expected to achieve 63% of the input voltage. The remaining 37% of the input voltage will take exponentially longer to achieve, and this is fundamental basis of capacitor operation. Higher frequency places higher demands on microcontroller 100, but generally will result in a more stable voltage applied to actuator 50. This makes sense because as the frequency increases, time between updates decreases, and the multiplexing scheme more closely resembles a continuous system.

Microcontroller 100 provides actuator commands or instructions to at least one actuator 50. Each actuator instruction is either a 1 or a 0. In normally open mode, an instruction of 1 causes at least one actuator 50 to move at least one pin 60 and restrict fluid flow. In normally closed mode, an instruction of 1 causes at least one actuator 50 to move at least one pin 60 and allow fluid flow. In general, an instruction of 1 from computer 90 relates to charging actuator 50, and an instruction of 0 relates to draining the charge. Microcontroller 100 handles this by updating the states of specific digital I/O ports located on microcontroller 100. As will be discussed in detail, to affect at least one actuator 50, the digital I/O ports of microcontroller 100 should be connected to at least one actuator 50 through a circuit. While the number of ports can vary, the number of ports required can be related to the design of the circuit.

Figure 12:
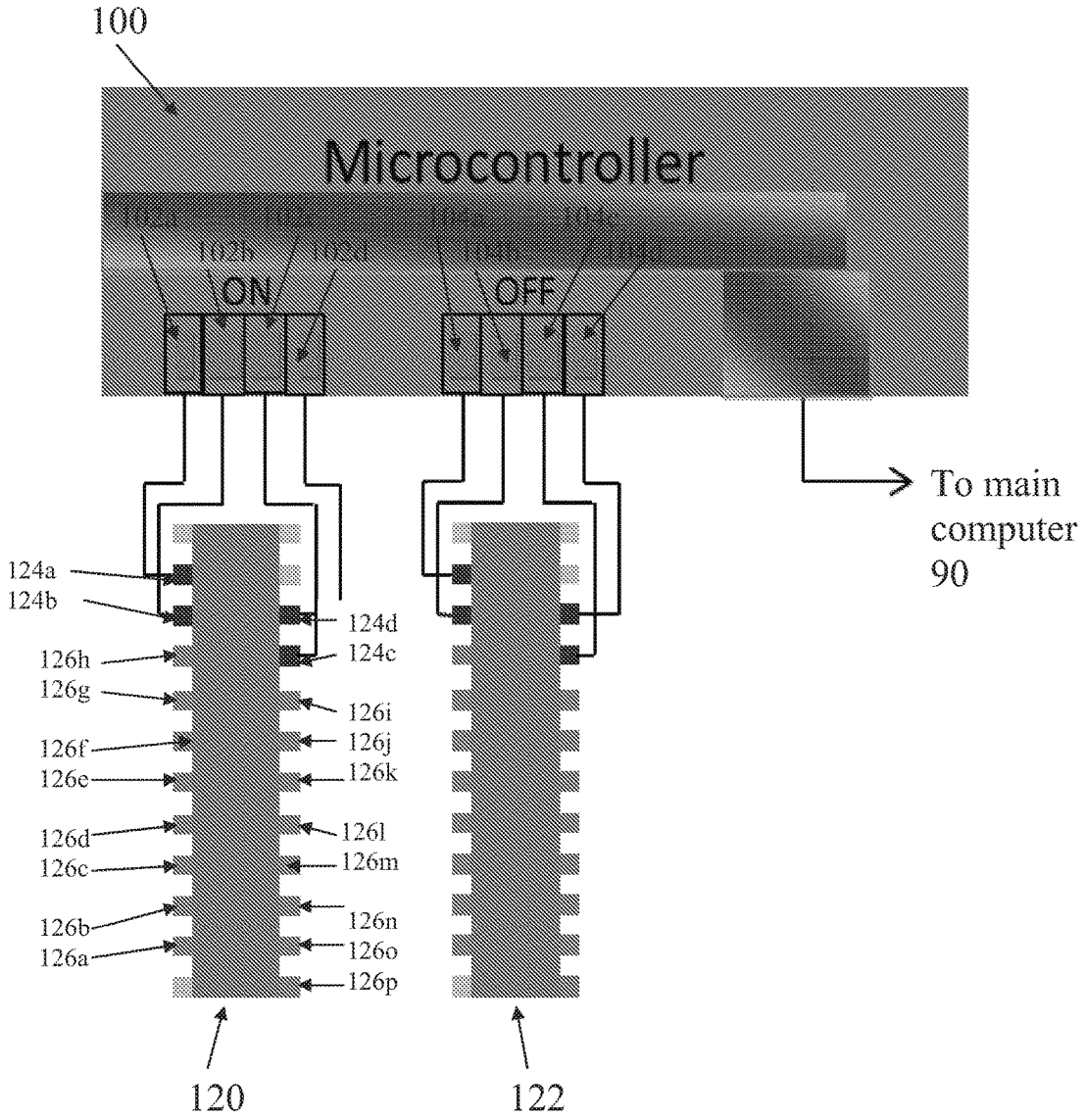
FIG. 12 illustrates a connection between the microcontroller input/output ports and the decoder inputs in accordance with an exemplary embodiment of the disclosure.
Figure 13:
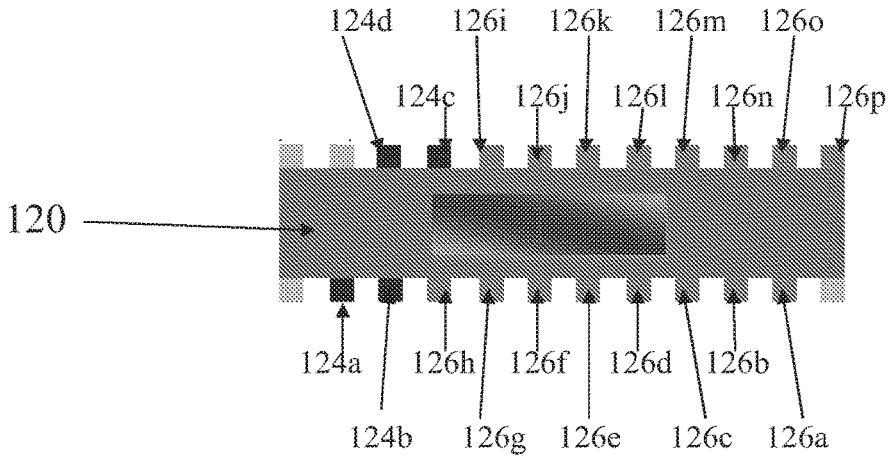
FIG. 13 illustrates a line decoder in accordance with an exemplary embodiment of the disclosure.
Figure 14:
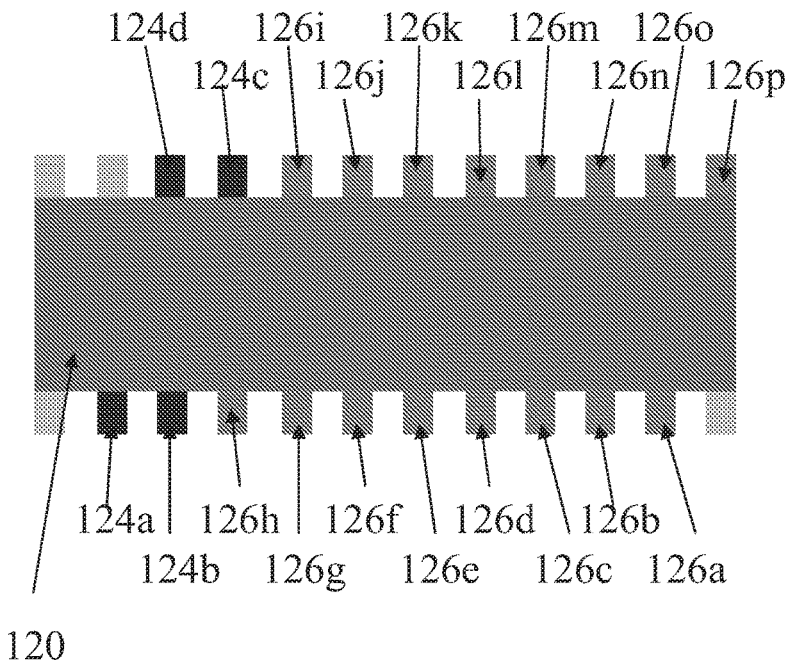
FIG. 14 shows an exemplary truth table and decoder in accordance with an exemplary embodiment of the disclosure.

Referring now to FIG. 12, in one embodiment according to this disclosure, actuator control system 80 may further comprise line decoders 120, 122 connected to microcontroller 100 at the I/O ports of microcontroller 100. One of line decoders 120, 122 can be seen in more detail in FIG. 13. As seen therein, line decoder 120 has four input pins 124*a*, 124*b*, 124*c*, 124*d*, which control 16 output pins, 126*a-p*. Referring back to FIG. 12, input pins 124*a*, 124*b*, 124*c*, 124*d* of decoders 120, 122 are connected to specified digital I/O ports 102*a-d*, 104*a-d* on microcontroller 100. One of decoders 120, 122 can be used to process charge instructions (an instruction of 1), while the other of decoders 120, 122 can be used to process drain instructions (an instruction of 0). Decoders 120, 122 may be used in conjunction with microcontroller 100 to select the appropriate actuator. This can be done by configuring I/O ports 102*a-d*, 104*a-d* on microcontroller 100 according to what is called a truth table. FIG. 14 illustrates an exemplary truth table 106 and decoder 120. By setting input pins 124*a-d* of decoder 120 according to truth table 106, for example "0-1-0-0", a specific output "3" can be selected. This simply means that the voltage at output pin 126*b* goes from OV to 5V.

Figure 15:
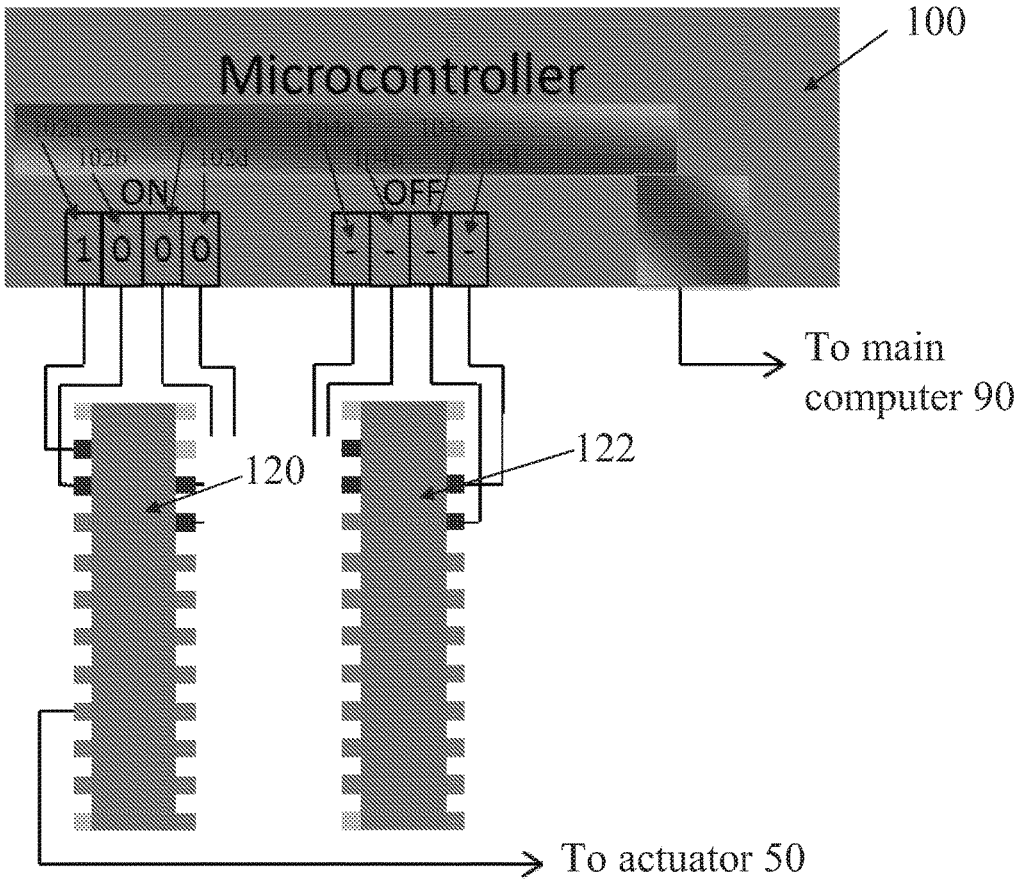
FIG. 15 illustrates an actuator instruction being processed in accordance with an exemplary embodiment of the disclosure.

In operation of the embodiment including line decoders 120, 122, microcontroller 100 processes an actuator instruction by configuring inputs 124*a-d* to one of decoders 120, 122 such that the appropriate actuator may be selected to either receive a charge or drain its charge depending on the instruction. FIG. 15 illustrates the processing of an actuator instruction in accordance with an exemplary embodiment of this disclosure. The command from computer 90 (not shown) includes an instruction for at least one actuator 50 to be charged. On microcontroller 100, this may be done by configuring the states of "on" I/O ports 102*a-d* such that at least one actuator 50 can be selected by decoder 120. It can be seen therein that the states are configured as "1-0-0-0," which is the same as "5v-0v-0v-0v." This causes a specific output pin on the decoder pin to be turned on. Because there are four inputs 124*a-d* to decoder 120, there are 16 different arrangements for selecting one of 16 output pins 126*a-p*. If I/O ports 102*a-d* of microcontroller 100 were arranged as "0-1-0-0", then a different output pin on the decoder would be selected.

As discussed, at least one actuator 50 may not be directly connected to microcontroller 100, but rather can be connected indirectly through circuit 110 via decoders 120, 122. In addition to decoders 120, 122, circuit 110 preferably also comprises one or more switches.

Figure 16:
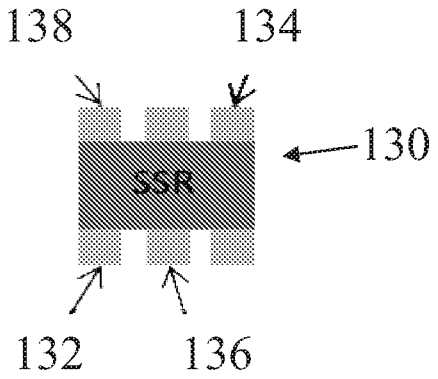
FIG. 16 illustrates a solid state relay circuit component in accordance with an exemplary embodiment of the disclosure.
Figure 17:
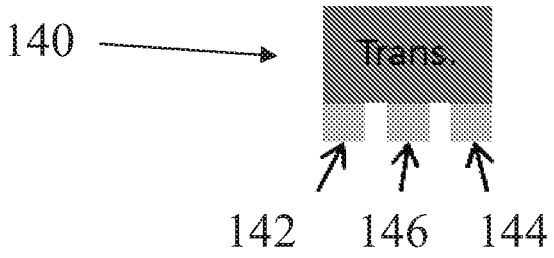
FIG. 17 illustrates a transistor circuit component in accordance with an exemplary embodiment of the disclosure.

At least one actuator 50 generally requires at least one switch for successful operation. According to one embodiment, solid state relays (SSR) are used as a high voltage switch to power each actuator, while transistors are used as a switch to drain the actuators. FIG. 16 shows an exemplary solid state relay 130 having input 132, output 134, connection 136 to ground and connection 138 to the power source. Suitable solid state relays may be any SSR that can handle the voltage that needs to be applied to the actuator. For example, in a model system, 100V is applied; therefore, an SSR that switches 90V would not work because the SSR in this case needs to be able to switch 100V or greater. One such SSR is Clare LCA110 solid state relay, which is capable of switching up to 350V. FIG. 17 shows an exemplary transistor 140 with input 142, output 144 and a connection 146 to actuators 50 (not shown). Transistors are selected according to their ability to handle current, which current is related to draining of the actuator. Draining an actuator occurs in duration equal to the time constant τ as calculated in Equation 5. Using Equation 66, in which C is the capacitance of the actuator, dV is the change in voltage, and dt is the time constant τ, Equation 5 can be substituted in to derive Equation 7 for calculating current and, therefore, determining a suitable transistor.

$$i = C\frac{dV}{dt} \quad \text{Equation 6}$$

$$i = \frac{dV}{R} \quad \text{Equation 7}$$

An example of a transistor that can be used according to an exemplary embodiment of this disclosure is a ST BD712 transistor, which can handle currents as high as 18 amps.

Figure 18:
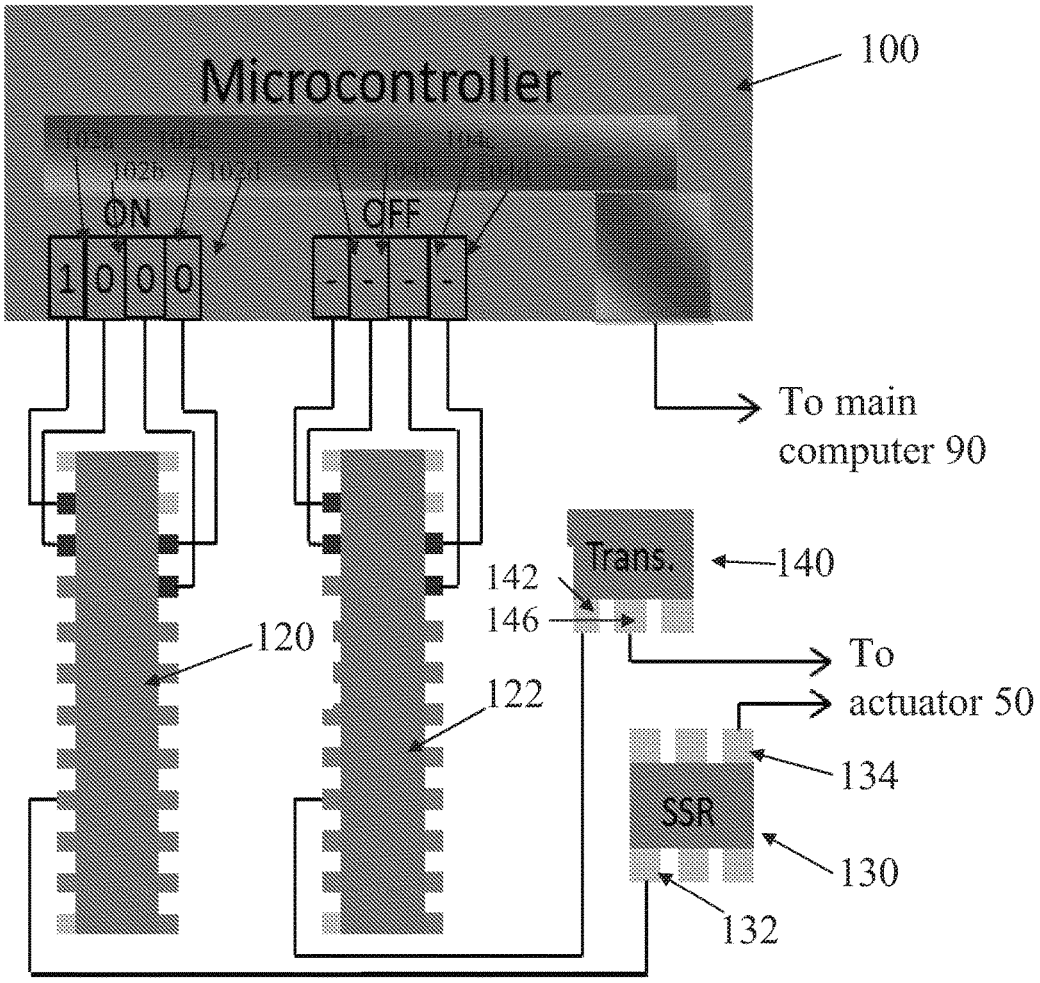
FIG. 18 illustrates a connection between the microcontroller and the actuator via the transistor, solid state relay, and decoder in accordance with an exemplary embodiment of the disclosure.

Inputs 132, 142 of solid state relay 130 and transistor 140, respectively, can be each connected to one of decoders 120, 122 but not to the same one, as seen in FIG. 18. Also shown therein is that both SSR 130 and transistor 140 connect to actuator 50, thereby connecting microcontroller 100 to actuator 50.

Figure 19:
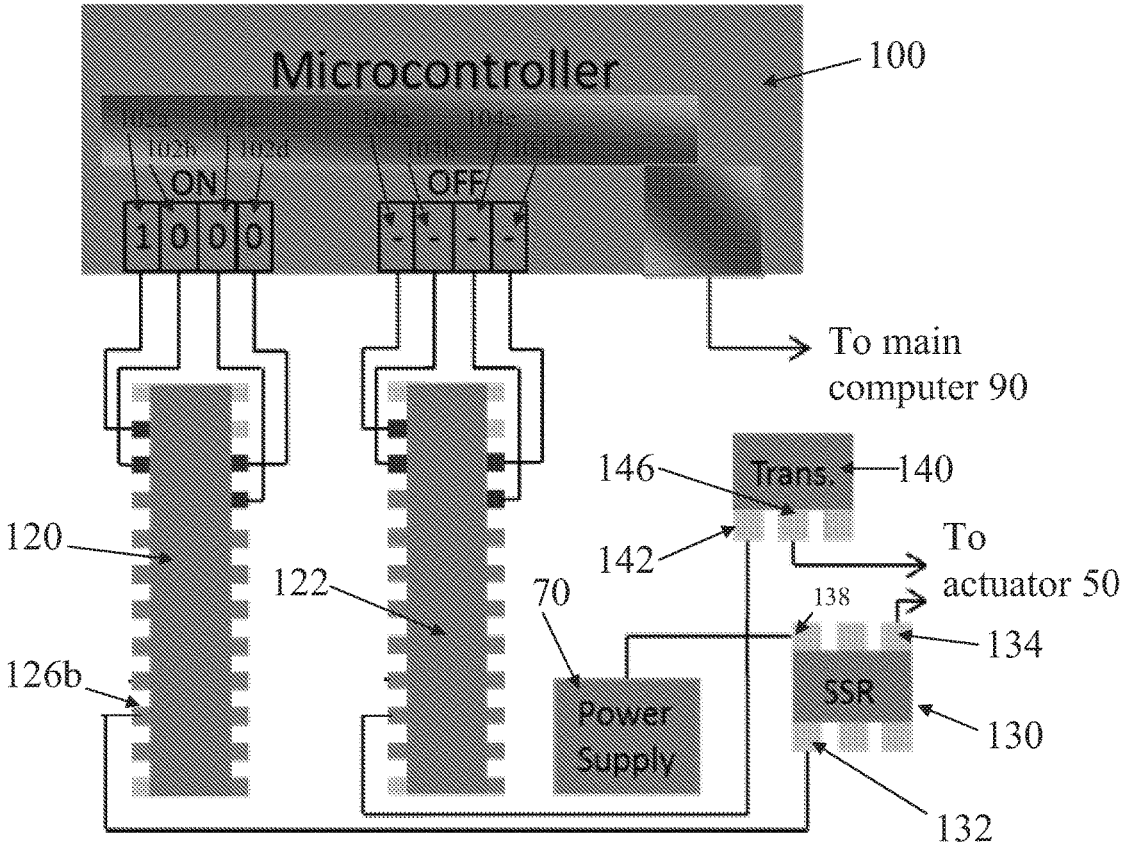
FIG. 19 illustrates a charging operation of an actuator in accordance with an exemplary embodiment of the disclosure.
Figure 20:
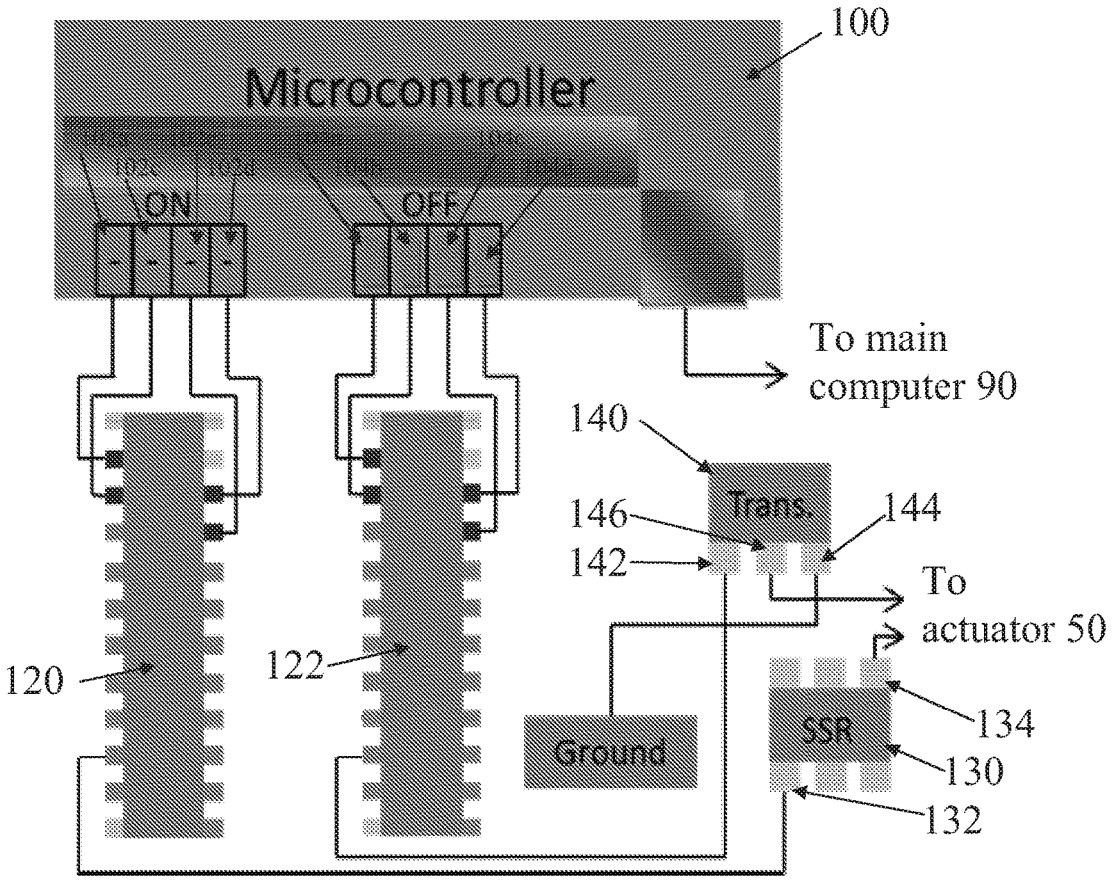
FIG. 20 illustrates a draining operation of an actuator in accordance with an exemplary embodiment of the disclosure.

In operation, an actuator may be charged by the power source when the SSR for that particular actuator is selected (switched "on" by the decoder to which it is attached). When this occurs, the actuator can controlled by the microcontroller operating commands from the main computer. Similarly, at least one actuator may be shut off (drained of its charge) when the transistor for that actuator is selected by the decoder it is connected to. Because of multiplexing, only one actuator may be operated at a time through either the transistor switch or SSR switch. Multiple actuators and multiple switches can never be operated simultaneously. For example, in FIG. 19, actuator 50 (not shown) is charged, denoted by the "on" I/O ports 102*a-d* having the format "1-0-0-0" selecting output pin 126*b* on respective decoder 120, which is connected to input 132 of SSR 130. Also seen therein is that the "off" I/O ports 104*a-d* are indicated as "- - - -", which means no output on the connected decoder is selected. In FIG. 20, the reverse is true, and the result would be for the charge on actuator 50 to be drained.

Figure 21:
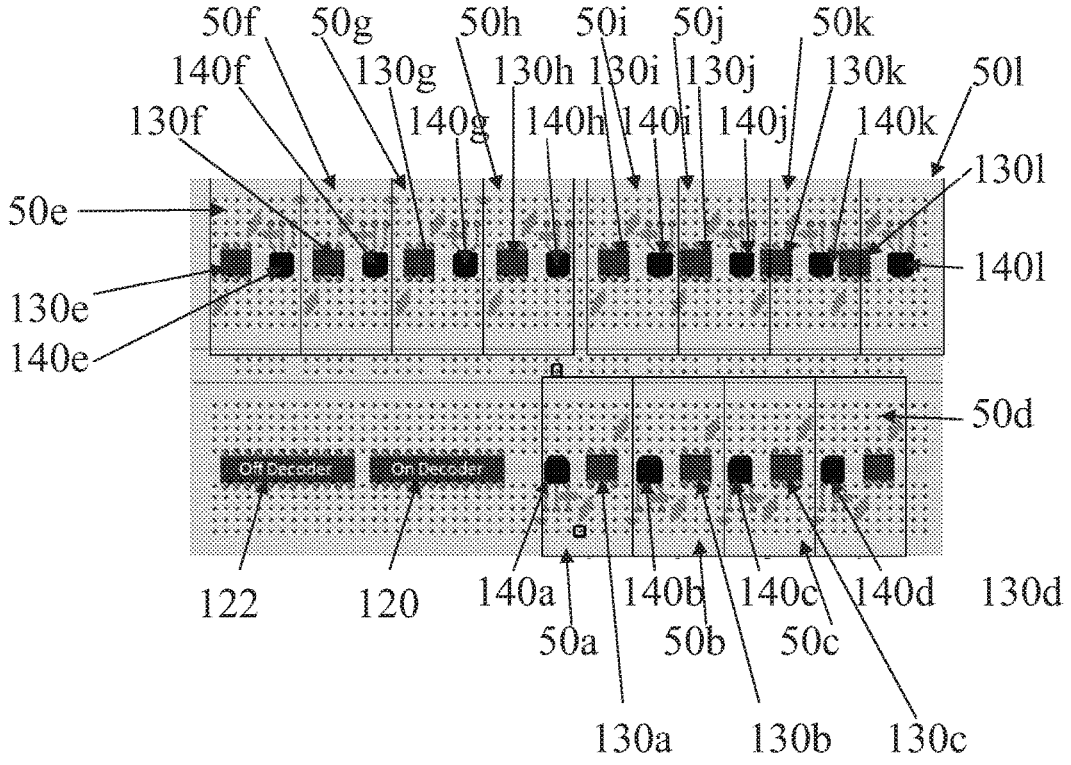
FIG. 21 illustrates an exemplary circuit layout in accordance with an exemplary embodiment of the disclosure.
Figure 22:
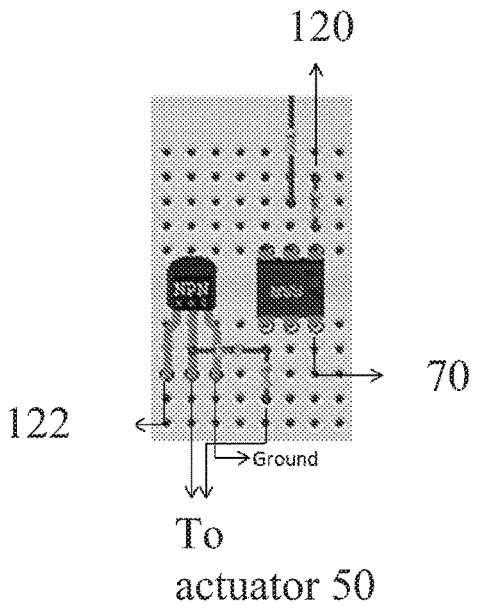
FIG. 22 illustrates the layout of a single actuator according to an exemplary embodiment of the disclosure.

FIG. 21 shows a circuit layout in accordance with an exemplary embodiment of this disclosure. As seen therein, circuit 110 comprises decoders 120, 122 and 12 actuators 50*a*-1, 12 solid state relays 130*a*-1, and 12 transistors 140*a*-1. FIG. 22 shows the layout of the components of one at least one actuator 50 of FIG. 21.

This disclosure also includes a method of preparing a patterned thin film material. According to the method, a desired surface pattern is first designed. The parameters of the designed surface pattern are input into a computer. A substrate having a substrate surface is passed under a hybrid patterning apparatus, and the designed surface pattern is patterned onto the passing substrate surface using the hybrid patterning apparatus.

Substrates and fluids suitable for use in this disclosure can be any material one of ordinary skill would use in a thin film apparatus. Suitable substrates for use in accordance with this disclosure include, but are not limited to, paper, glass, thin plastic film, and thin metallic film. Plastic film is the preferred substrate. Suitable fluids that may be deposited in the patterning of the substrate include, but are not limited to, dispersions and organic and inorganic polymer solutions.

EXAMPLES

In accordance with this disclosure, a system has been designed and fabricated for the purpose of producing customized thin films. Initial studies have been performed to demonstrate such a system and to produce basic patterns as seen in various emergent technologies.

In the proposed system, a digital file containing a desired pattern can be used as an input that controls the operation of a film creating process. Slot coating was chosen as the film creating process because of the quality of films that can be obtained. A key parameter in initial studies was system functionality in terms of being able to receive an input pattern and produce an output film that resembled said input.

First, a slot die was developed to produce uniform flow. CFD was performed on the fluid domain and it was found that the analytical and numerical results correlated well. Furthermore, the geometry of the die was tailored to accommodate the integration of piezo electric actuators. After finalizing the internal geometry of the die, further analysis was performed to select a material for use in fabricating the die. It was determined to use a plastic material such as polycarbonate with a thickness of 4 mm to minimize costs. Polycarbonate was chosen as the material for building the prototype as the tensile strength is between that of nylon and aluminum and the material is transparent, which enables viewing of flow characteristics during experiments.

Available actuator technology was surveyed and it was determined that piezoelectric bender style were the optimal choice based on cost, infrastructure requirements, and power consumption. After fabricating the die and actuators, a computer control methodology was designed and implemented to operate the actuators according to an input pattern. The computer control method consisted of a main computer capable of running MATLAB, a microcontroller, and a multiplexing circuit. The main computer with MATLAB is used to run a user GUI, which executes a script to import a user defined 2D pattern, create actuator commands, and send them to the microcontroller. The microcontroller is used to receive actuator commands and process them according to a multiplexing scheme. This scheme is meant to reduce demands placed on a power source, making the system lower cost and also ready to be expanded in the future. The microcontroller is connected to a circuit which operates according to the microcontroller updates by switching power to the actuators on and off as needed.

A computer program capable of receiving 2D patterns in a .dxf file and producing appropriate actuator instructions was written. The combined use of a specially-designed microcontroller program and circuit were used to process instructions from the control program, and accommodate future system expansion through multiplexing.

Figure 23:
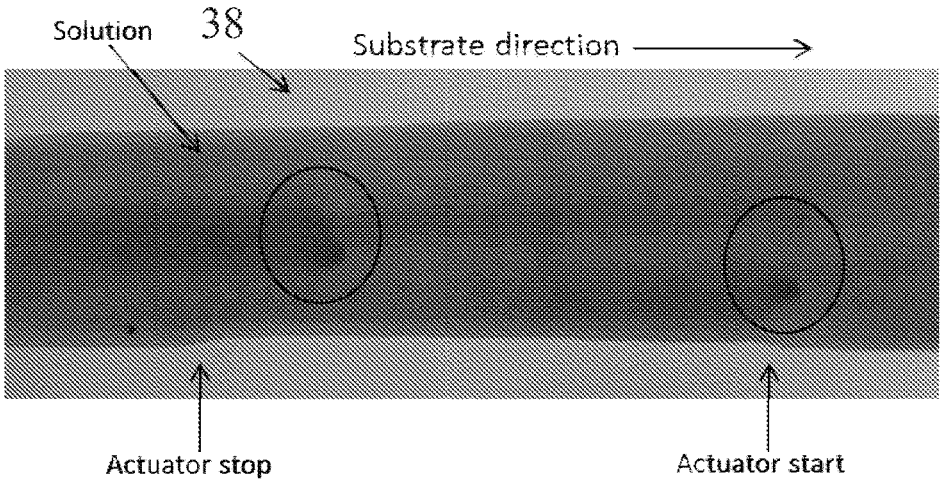
FIG. 23 shows initial test results using manual control in accordance with an exemplary embodiment of the disclosure.

An initial test was run with the actuators operating in normally open mode and manual operation of Actuator 1. In manual operation, no pattern is input, but rather a specific actuator is chosen from the GUI for operation. By default the pin will operate for 5 seconds. A required user input for manual operation is the substrate speed, which was, in this case, 0.7 cm/second. At this rate for 5 seconds, the result was expected to be an interruption in fluid flow corresponding to the region controlled by Actuator 1 with a length roughly 3.5 cm. FIG. 23 shows the observed results using manual control. It appears that the actuator successfully interrupted flow in the expected manner; however, it can be noted from the appearance of the result that the film quality was not as good as hoped. Several factors may have contributed to this, one of which is that the substrate was paper. Paper was used as a substrate to lower the cost of initial experiments by reducing the use of another material such as PET and also eliminate the need of surface treatments.

Figure 24:
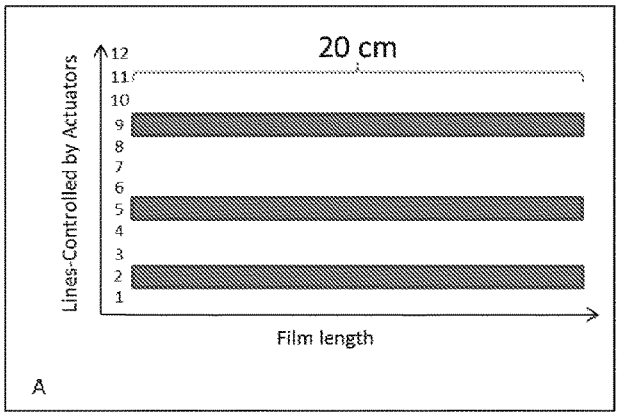
FIG. 24 shows an input pattern of three lines in accordance with an exemplary embodiment of the disclosure.

The automatic, patterned control aspect was tested using a pattern consisting of three lines of 20 cm each as shown in FIG. 24. This pattern was designed to demonstrate that extrusions down to the resolution of a single pin could be obtained, while at the same showing that the pins adequately closed off flow in areas determined by the input file.

Figure 25:
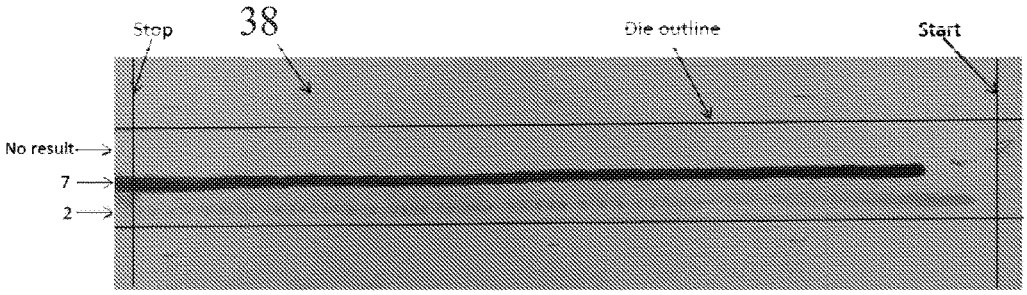
FIG. 25 shows some test results in accordance with an exemplary embodiment of the disclosure.

In this instance, the substrate speed was 1 cm/second, and the actuators were operating in normally closed mode. The output is shown in FIG. 25 and was inconclusive to an extent. It can be seen that in Region 2, the solution was not deposited uniformly, while a heavy coating was produced in Region 7 which was not included in the control pattern. Also, no solution was deposited in Region 9. Issues related to the observed outcome could be incorrect circuit wiring, quality of machined surfaces on the die halves, and actuator operation. Circuit wiring was confirmed by a voltage audit during operation, and it was found that an appropriate voltage was being sent to the correct actuators. Under microscopic observation, it was determined that while the actuators where receiving the correct charge, they were not displacing as expected. From this it was speculated that friction may be interfering with operation. This is also supported by noting that solution was still being deposited after the "stop" line, which indicates that the flow was not stopped by the actuators as it should have been in normally closed mode.

Results of test runs were both successful and inconclusive. Films were produced which resembled input patterns, but issues such as reliable pin operation, flow leakage, and simple patterns prevented the endeavor from being a complete success. Yet, a plausible approach to on demand creation of thin films with customized patterns was realized. Simple input patterns were tested and found to produce appropriate response from actuators, indicating a successfully implemented control scheme. Furthermore, resulting films resembled input pattern to varying degrees. The prototype system provided a plausible system for further development.

The embodiments of this disclosure are not limited to the particular formulations, process steps, and materials disclosed herein as such formulations, process steps, and materials can vary somewhat. Moreover, the terminology employed herein is used for the purpose of describing exemplary embodiments only, and the terminology is not intended to be limiting as the scope of the various embodiments of this disclosure will be limited only by the appended claims and equivalents thereof.

While embodiments of this disclosure have been described in detail with particular reference to exemplary embodiments, those skilled in the art will understand that variations and modifications can be effected within the scope of the disclosure as defined in the appended claims. Accordingly, the scope of the various embodiments of this disclosure should not be limited to the above discussed embodiments, and should only be defined by the following claims and all equivalents.

We claim:

1. A hybrid patterning apparatus, comprising:

a slot die having a body comprising first and second plates, wherein each of the first and second plates has a top end and a bottom end;

a cavity positioned between the first and second plates of the slot die;

an inlet positioned at the top end of the body of the slot die;

a slot gap having a slot width and located between the first and second plates leading from the cavity to an opening at the bottom end of the slot die; and at least one moveable pin, wherein an internal end of the at least one pin fills at least a portion of the slot gap, and an external end of the at least one pin extends beyond an exterior of the slot die body.

2. The hybrid patterning apparatus of claim 1, further comprising at least one actuator connected to the external end of the at least one pin.

3. The hybrid patterning apparatus of claim 2, wherein the at least one actuator is selected from the group consisting of servo motors, and electromagnetic, electrostatic, piezoelectric, and pneumatic actuators.

4. The hybrid patterning apparatus of claim 2, wherein the at least one actuator is also connected to the exterior of the slot die body.

5. The hybrid patterning apparatus of claim 3, comprising a plurality of pins and actuators.

6. The hybrid patterning apparatus of claim 5, wherein the plurality of pins and actuators is housed within the first and second plates in an alternating pattern.

7. The hybrid patterning apparatus of claim 3, wherein the at least one actuator is connected to a power source.

8. The hybrid patterning apparatus of claim 1, wherein the apparatus comprises a material selected from the group consisting of stainless steel, aluminum, nylon, polycarbonate and combinations thereof.

9. A hybrid patterning system, comprising:

a hybrid patterning apparatus comprising a slot die having a body comprising first and second plates, wherein each of the first and second plates has a top end and a bottom end, a cavity positioned between the first and second plates of the slot die, a slot gap located between the first and second plates leading from the cavity to an opening at the bottom end of the slot die, at least one moveable pin, wherein an internal end of the at least one pin fills at least a portion of the slot gap, and an external end of the at least one pin extends beyond an exterior of the slot die body; and at least one actuator connected to the external end of the at least one pin;

a power source; and an actuator control system.

10. The hybrid patterning system of claim 9, wherein the hybrid patterning apparatus is connected to the power source.

11. The hybrid patterning system of claim 9, wherein the actuator control system is connected to the power source.

12. The hybrid patterning system of claim 9, wherein the actuator control system comprises a computer, a microcontroller, and a circuit.

13. The hybrid patterning system of claim 12, further comprising means of communication between the computer and the microcontroller.

14. The hybrid patterning system of claim 12, wherein the microcontroller is connected to the circuit.

15. The hybrid patterning system of claim 13, wherein the means of communication is selected from the group consisting of wired communication means and wireless communication means.

16. The hybrid patterning system of claim 13, wherein the means of communication is a wired connection between the computer and the microcontroller.

* * * * *